US006572492B2

(12) United States Patent
Tinsman

(10) Patent No.: US 6,572,492 B2
(45) Date of Patent: Jun. 3, 2003

(54) KINETICALLY RECHARGEABLE SOUND-EMITTING GOLF BALL

(76) Inventor: William J. Tinsman, 9 Lincoln Ave., Berryville, VA (US) 22611

( * ) Notice: Subject to any disclaimer, the term of this patent is extended or adjusted under 35 U.S.C. 154(b) by 142 days.

(21) Appl. No.: 09/858,053

(22) Filed: May 15, 2001

(65) Prior Publication Data

US 2002/0173378 A1 Nov. 21, 2002

(51) Int. Cl.[7] ..... A63B 43/00

(52) U.S. Cl. ..... 473/353; 473/351; 473/571; 473/570; 473/371; 473/375

(58) Field of Search ..... 473/351, 353, 473/569, 570, 571, 371, 375

(56) References Cited

U.S. PATENT DOCUMENTS

| | | | | |
|---|---|---|---|---|
| 4,840,371 A | | 6/1989 | Harris | |
| 5,112,055 A | | 5/1992 | Barnhill | |
| 5,423,549 A | * | 6/1995 | Englmeier | 473/353 |
| 5,447,314 A | | 9/1995 | Yamazaki et al. | |
| 5,626,531 A | | 5/1997 | Little | |
| 5,868,633 A | | 2/1999 | Keheley | |
| 5,952,921 A | | 9/1999 | Donnelly | |
| 6,011,466 A | | 1/2000 | Goldman | |
| 6,113,504 A | * | 9/2000 | Kuesters | 473/353 |
| 6,118,376 A | | 9/2000 | Regester | |
| 2002/0091017 A1 | * | 7/2002 | Kuesters | 473/353 |
| 2002/0098913 A1 | * | 7/2002 | Goldman | 473/353 |

* cited by examiner

*Primary Examiner*—J. Harrison
(74) *Attorney, Agent, or Firm*—Dale J. Ream

(57) ABSTRACT

A sound-producing golf ball includes an outer shell with a shock-absorbent inner housing having a rechargeable micro-battery positioned therein. A micro-generator coupled to a rotatably mounted shaft is positioned in the housing. A pendulum depending from the shaft is urged downwardly by gravity for rotating the shaft as the golf ball rolls while in play, thus generating electricity for recharging the micro-battery. A sound chip having a memory for storing audible messages is positioned in the housing along with a sound generator for audibilizing the messages when energized. The housing may include a receiver for receiving a signal from a transmitter for selectively energizing operation of the sound chip and sound generator. The housing presents a geodesic configuration and includes a plurality of interconnected tetrahedral structures for absorbing impact forces.

19 Claims, 3 Drawing Sheets

KINETICALLY RECHARGEABLE SOUND-EMITTING GOLF BALL

BACKGROUND OF THE INVENTION

This invention relates generally to golf balls and, more particularly, to a golf ball having a kinetically rechargeable battery and sound emitting components that may be remotely energized.

Locating one's golf ball after striking it a considerable distance or after striking it out-of-bounds is a problem experienced by every golfer. Completely losing one's ball, of course, results in an undesired two stroke penalty. Various devices have been proposed in the art for locating a lost golf ball through sound emissions, such as those disclosed in U.S. Pat. Nos. 5,447,314 and 6,011,466. Although assumably effective for their intended purposes, existing devices contain electronic components powered by a micro-battery that is either not rechargeable or requires an exterior battery recharging unit.

Therefore, it is desirable to have a sound-emitting golf ball having a micro-generator for converting the kinetic energy of a rolling golf ball into electrical energy for recharging a micro-battery. Further, it is desirable to have a sound-emitting golf ball having a geodesic inner housing with interconnected tetrahedral structures for protecting the electronic components. Finally, it is desirable to have a golf ball which may be remotely energized to emit humorous or complimentary messages.

SUMMARY OF THE INVENTION

A sound-emitting golf ball according to this invention includes a conventional and spherical dimpled outer shell. An inner housing is positioned centrally within the outer shell. The housing presents a polygonal, geodesic configuration and includes a plurality of interconnected tetrahedral support structures mounted in a chamber defined by the housing. The configuration of the housing and support structures enables the impact force imparted by a golf club head against the outer shell to be distributed over and absorbed by the entire ball rather than merely by the point of impact. Therefore, electronic components mounted in the chamber of the housing are protected.

A rechargeable micro-battery is positioned in the housing and is coupled to a micro-generator. The micro-generate is coupled to a rotatably mounted shaft. The shaft is rotated as gravity urges a pendulum toward the ground as the golf ball rolls or spins during game play. The kinetic energy of shaft rotation is converted into electrical energy by the micro-generator for recharging the micro-battery. A miniature receiver, a digital sound chip with a memory, and a sound generator are also positioned in the chamber and are electrically connected to the micro-battery. The digital sound chip includes a memory for storing a plurality of messages, whether humorous or complimentary. When the receiver receives an appropriate activation signal from a remote transmitter, the receiver permits current from the micro-battery to energize the sound chip to deliver a respective stored message to the sound generator. Preferably, the sound generator is a piezoelectric transducer capable of audibilizing the delivered message. A plurality of tubular sound pipes carry the audible sounds produced by the sound generator to the outer shell so that they may be better heard by a person.

Therefore, a general object of this invention is to provide a golf ball which emits sounds to assist golfers in locating the ball.

Another object of this invention is to provide a golf ball, as aforesaid, which audibilizes one of a sequence of preprogrammed audible messages each time it is activated.

Still another object of this invention is to provide a golf ball, as aforesaid, which may be remotely actuated.

Yet another object of this invention is to provide a golf ball, as aforesaid, which protects inner electronic components from impact forces with an inner housing having a geodesic configuration with a plurality of tetrahedral support structures positioned therein.

A further object of this invention is to provide a golf ball, as aforesaid, in which its internal components are weighted so that the ball is appropriately balanced for proper flight.

A still further object of this invention is to provide a golf ball, as aforesaid, wherein the preprogrammed audible messages may be humorous or complimentary.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENTS

Figure 1:
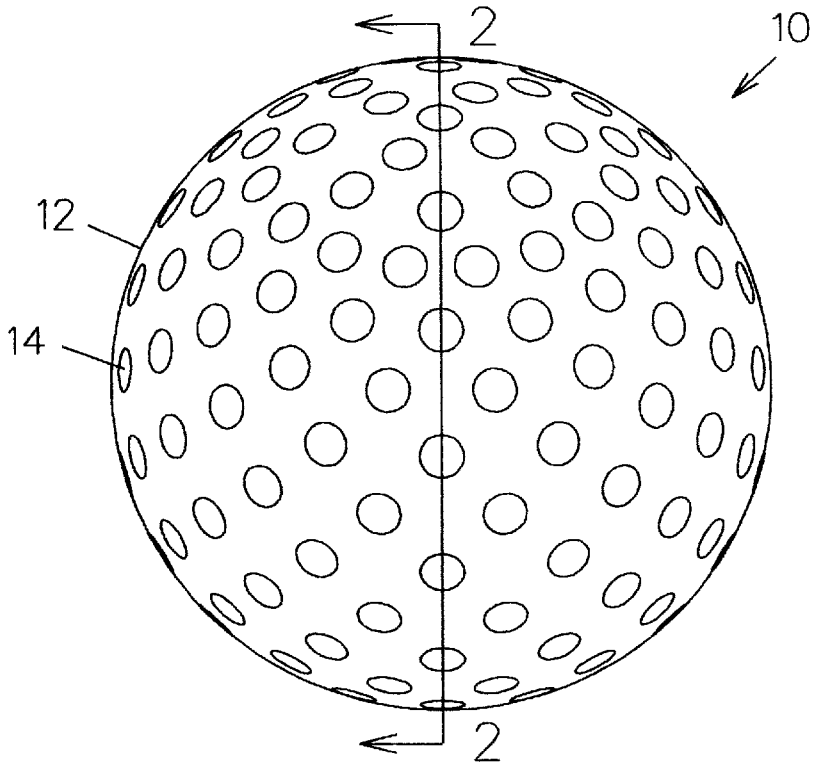
FIG. 1 is a perspective view of a golf ball according to the present invention.
Figure 2:
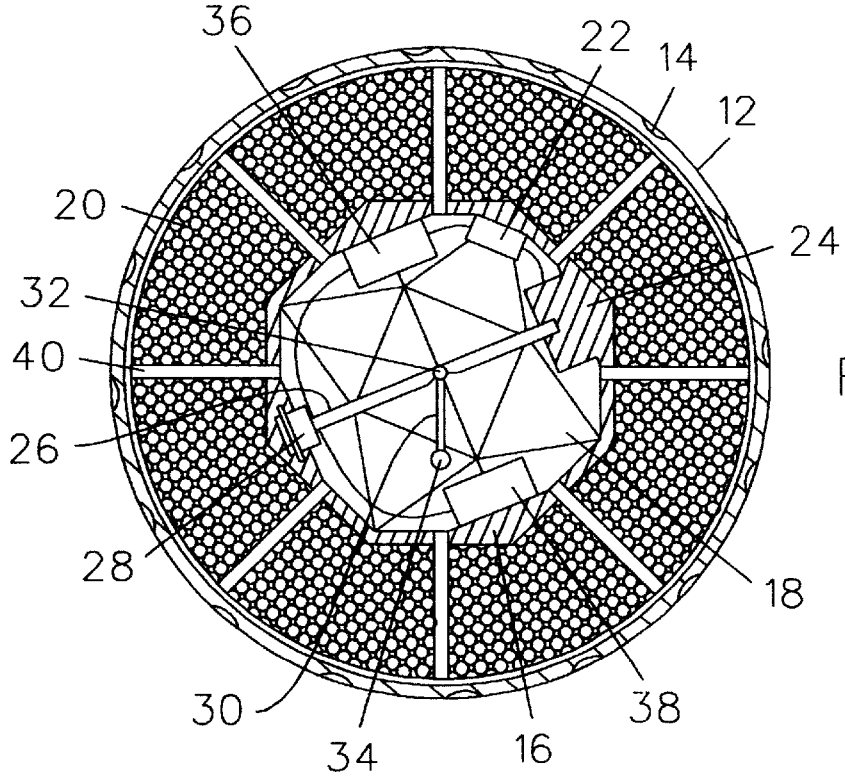
FIG. 2 is a sectional view taken along line 2—2 of FIG. 1 according to an embodiment of the present invention not having remote actuation.

A sound-emitting golf ball 10 according to a preferred embodiment of the present invention will now be described with reference to FIGS. 1 through 4 of the accompanying drawings. The golf ball 10 includes a spherical outer shell 12 defining a plurality of dimples 14 spaced apart about its outer surface, as is conventional in the art (FIG. 1). The inner surface of the outer shell 12 includes a layer of hard resin. The golf ball 10 includes an inner housing 16 centrally positioned within the outer shell 12 and forming the core of the ball. The housing 16 presents a multifaceted polygonal structure also referred to as a geodesic configuration (FIG. 3) and is preferably constructed of titanium although a resilient plastic material would also work. The housing 16 defines an interior chamber and includes a plurality of interconnected tetrahedral support structures 18 positioned in the chamber (FIG. 2). At least one vertex of each tetrahedral support structure 18 bears against the outer wall of the housing and at least another vertex is connected to an adjacent tetrahedral support structure. Therefore, the geodesic configuration of the housing 16 and the tetrahedral support structures 18 therein enable an impact force to be quickly distributed amongst all of the shock absorbing structures with each structure absorbing a part of the impact force. A rubber strand is wound tightly about the exterior of the inner housing 16 so as to form a rubber layer 20 intermediate the housing 16 and outer shell 12 (FIG. 3).

Figure 3:
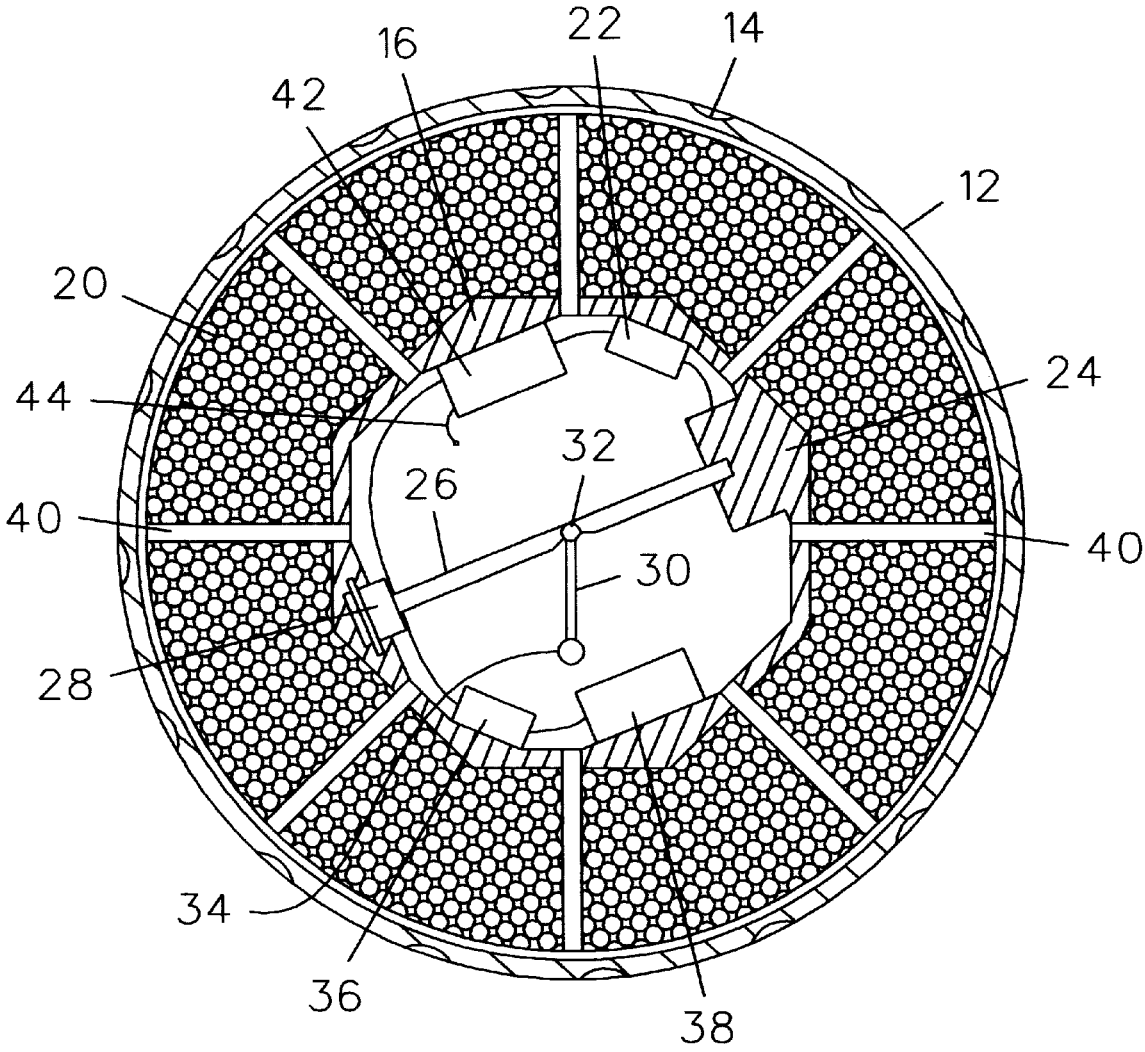
FIG. 3 is a sectional view as in FIG. 2 on an enlarged scale according to an embodiment of the invention having remote actuation and having the plurality of tetrahedral support structures removed.

A rechargeable micro-battery 22 is mounted in the chamber of the housing 16 (FIG. 3). A micro-generator 24 is also positioned in the chamber for recharging the micro-battery 22. A shaft 26 extends substantially across the diameter of the chamber and is rotatably coupled to a housing wall with a bearing 28 such that the shaft 26 is freely rotatable. A pendulum 30 is pivotally coupled to the shaft 26 intermediate opposed ends thereof and depends from the shaft 26. A free end of the pendulum 30 includes a mass 34 such that the pendulum 30 is always being urged toward a ground surface by gravitational forces. The pendulum 30 is pivotally coupled to the shaft 26 with a ball joint 32 so that the pendulum 30 is free to pivot toward the ground regardless of the orientation of the shaft 26. In other words, the mass 34 of the pendulum 30 is able to move toward a ground surface and correspondingly cause the shaft 26 to rotate unless the trajectory and spinning motion of the golf ball is completely parallel to an imaginary longitudinal axis formed by the shaft 26. The micro-generator 24 is coupled to the shaft 26 for converting the kinetic energy of shaft rotation into electric energy. The micro-generator 24 is electrically coupled to the micro-battery 22 with a wire for recharging the micro-battery 22 as electric energy is produced.

The golf ball 10 further includes a digital sound chip 36 mounted in the interior chamber of the housing 16. The digital sound chip 36 includes a memory capable of digitally storing a plurality of messages. The messages may be complimentary, such as "nice shot", or humorous such as "out-of-bounds again!". It is understood of course that the aforesaid messages are only representative and not limiting. The digital sound chip 36 is electrically connected to a sound generator 38 and is capable of delivering a respective message thereto when energized. The digital sound chip 36 includes sequencing circuitry such that a next sequential message stored in the memory is delivered to the sound generator 38 each time those components are energized, as to be described more fully below. Preferably, the sound generator 38 is a piezoelectric transducer capable of audibilizing the messages. Of course, the sound generator 38 may be in the form of a mere buzzer, beeper, or other sound generating device. The sounds audibilized by the sound generator 38 are carried outwardly from the chamber through a plurality of tubular sound pipes 40 spaced apart from one another and extending radially between the housing 16 and the outer shell 12. Each sound pipe 40 is in communication with the chamber but does not extend through the outer shell. An embodiment of the present invention having only the elements described above is shown particularly in FIG. 2.

Figure 4:
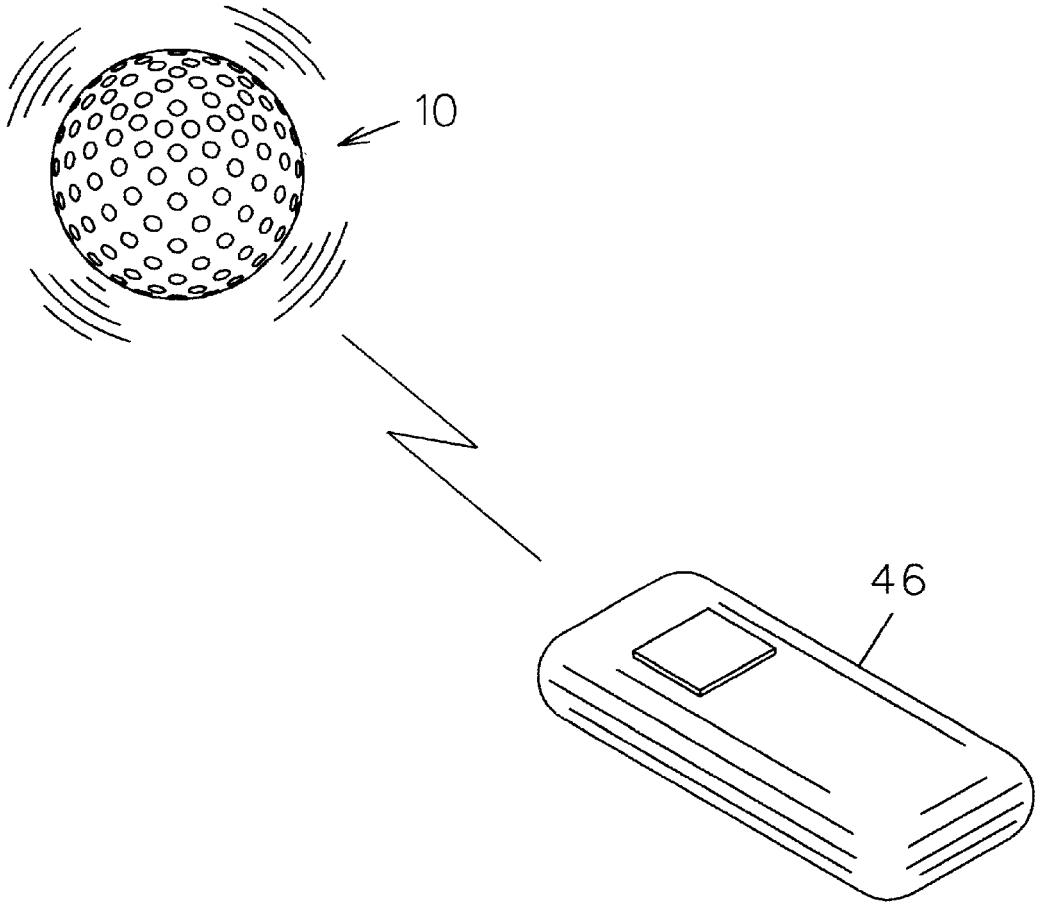
FIG. 4 is a diagrammatic perspective view of the present invention in use.

An embodiment of this invention having remote actuation of the sound elements described above is particularly shown in FIG. 3. A miniature receiver 42 having a miniature antenna 44 is mounted in the housing chamber. The receiver 42 is capable of receiving a first signal from a remote transmitter, the transmitter being housed in a transmitter housing 46 that may be held by a person looking for the ball (FIG. 4). The transmitter generates and transmits the first signal upon a user request, i.e. upon a user pressing an appropriate button on the transmitter housing 46. The receiver 42 is electrically connected to the micro-battery 22 and to the digital sound chip 36 (FIG. 3) and permits current from the micro-battery 22 to be delivered to the sound chip 36 and sound generator 38 upon receiving a first signal. This current delivery causes a respective sequential message to be delivered from the sound chip 36 to the sound generator 38 and audibilized thereby.

It is understood that the golf ball described above may alternatively be constructed without a micro-generator and, therefore, with a non-rechargeable battery. Further, the chamber may be partially filled with a gelatin substance for further securing the electronic components in place. It should also be appreciated that the sound chip and sound generator may be actuated in a manner other than through a transmitter/receiver construction, such as by sensing impact, sensing a cessation of rotation, periodically, etc.

In use, the golf ball 10 may be placed on a tee and struck with a golf club as in a traditional golf game or may be secretly swapped with a regular ball for the purpose of playing a joke on a fellow player. When the ball 10 rolls as upon impact with the ground or as it spins in flight, the pendulum 30's response to gravity causes the shaft 26 within the housing chamber to rotate. As the shaft 26 rotates, kinetic energy is converted to electrical energy by the micro-generator 24 and the micro-battery 22 is recharged thereby. When a person operates the transmitter housing 46 so as to cause the transmitter therein to transmit a first signal, that signal is received by the receiver antenna 44. Accordingly, the receiver 42 permits current from the micro-battery 22 to energize the digital sound chip 36 and sound generator 38 such that the next sequential message stored in the sound chip memory is delivered to and audibilized by the sound generator 38. This sound is carried outwardly from the chamber to the outer shell 12 through the tubular sound pipes 40.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letter Patent is as follows:

1. A sound-emitting golf ball, comprising:

a shock absorbent housing defining an interior chamber;

a rechargeable micro-battery positioned in said chamber;

a sound generator positioned in said chamber and electrically connected to said micro-battery, said sound generator adapted to emit audible sounds into the ambient air for hearing by a person when energized by said micro-battery;

a shaft rotatably mounted in said chamber;

a mass depending from said shaft and adapted to cause said shaft to rotate as said mass is urged toward the ground by gravity upon rotation of said housing; and a micro-generator positioned in said chamber and axially coupled to said shaft for producing electrical energy upon rotation of said shaft, said micro-generator being electrically connected to said micro-battery for recharging said micro-battery upon production of said electrical energy.

2. The golf ball as in claim 1 further comprising:

a miniature receiver positioned in said chamber for receiving a first signal, said receiver being electrically connected to said micro-battery and to said sound generator;

a transmitter housing adapted to be carried by a person;

a transmitter mounted in said housing and adapted to selectably generate and transmit said first signal, said receiver permitting current from said micro-battery to energize said sound generator upon receiving said first signal.

3. The golf ball as in claim 2 wherein said housing includes a geodesic configuration and includes a plurality of interconnected tetrahedral structures positioned in said chamber for absorbing an impact force imparted by a golf club head.

4. The golf ball as in claim 1 wherein said housing includes a geodesic configuration and includes a plurality of interconnected tetrahedral structures positioned in said chamber for absorbing an impact force imparted by a golf club head.

5. The golf ball as in claim 4 further comprising:

an outer shell having a generally spherical configuration and defining a plurality of dimples spaced apart about an outer surface thereof; and a layer of rubber intermediate said housing and said outer shell, said rubber layer being wound about said housing for absorbing said impact force of a golf club.

6. The golf ball as in claim 1 further comprising:

an outer shell having a generally spherical configuration and defining a plurality of dimples spaced apart about an outer surface thereof; and a layer of rubber intermediate said housing and said outer shell, said rubber layer being wound about said housing for absorbing an impact force of a golf club struck against said outer shell.

7. The golf ball as in claim 1 further comprising:

a digital sound chip having a memory for storing a plurality of audio messages, said digital sound chip being electrically connected to said receiver and to said sound generator for delivering one of said audio messages to said sound generator when said sound generator is energized;

a plurality of tubular sound pipes extending radially from said housing, each sound pipe being in communication with said chamber for outwardly communicating said audible sounds emitted from said sound generator.

8. The golf ball as in claim 7 wherein said digital sound chip includes a sequencer circuit for sequencing said plurality of audio messages, whereby a next sequential audio message is delivered from said sound chip to said sound generator each time said sound generator is energized.

9. The golf ball as in claim 7 wherein said sound generator is a piezoelectric transducer.

10. The golf ball as in claim 1 wherein said housing is constructed of titanium.

11. The golf ball as in claim 1 wherein said mass is pivotally coupled to said shaft such that said mass is capable of causing said shaft to rotate so long as said housing is rotating along a trajectory that is not completely parallel to said shaft.

12. A sound-emitting golf ball, comprising:

an outer shell having a generally spherical configuration;

a housing positioned in said outer shell having a geodesic configuration and defining an interior chamber;

a plurality of interconnected tetrahedral structures positioned in said chamber and adapted to absorb a portion of an impact force imparted upon said outer shell by a golf club head;

a micro-battery positioned in said chamber;

a digital sound chip positioned in said chamber and having a memory adapted to store a plurality of audio messages, said digital sound chip being electrically connected to said micro-battery;

a sound generator positioned in said chamber and electrically connected to said digital sound chip, said digital sound chip adapted to deliver a respective audio message to said sound generator and said sound generator adapted to audibilize said respective audio message into the ambient air for hearing by a person when said digital sound chip is energized by said micro-battery.

13. The golf ball as in claim 12 wherein said micro-battery is rechargeable, said golf ball further comprising:

a shaft rotatably mounted in said chamber;

a pendulum depending from said shaft and adapted to cause said shaft to rotate as said pendulum is urged toward the ground by gravity upon rotation of said housing; and a micro-generator positioned in said chamber and axially coupled to said shaft for producing electrical energy upon rotation of said shaft, said micro-generator being electrically connected to said micro-battery for recharging said micro-battery upon production of said electrical energy.

14. The golf ball as in claim 12 further comprising:

a miniature receiver positioned in said chamber for receiving a first signal, said receiver being electrically connected to said micro-battery and to said digital sound chip;

a transmitter housing adapted to be carried by a person; and a transmitter mounted in said housing and adapted to selectably generate and transmit said first signal, said receiver permitting current from said micro-battery to energize said digital sound chip to deliver said respective audio message to said sound generator upon receiving said first signal.

15. The golf ball as in claim 12 further comprising a layer of rubber intermediate said housing and said outer shell, said rubber layer being wound about said housing for absorbing a portion of an impact force imparted against said outer shell by a golf club; and wherein said outer shell defines a plurality of dimples spaced apart about an outer surface thereof.

16. The golf ball as in claim 12 wherein said digital sound chip includes a sequencer circuit for sequencing the delivery of said plurality of audio messages to said sound generator, whereby a next sequential audio message is delivered from said digital sound chip to said sound generator each time said digital sound chip is energized.

17. The golf ball as in claim 12 wherein said pendulum is pivotally coupled to said shaft such that said pendulum is capable of causing said shaft to rotate so long as said housing is rotating along a trajectory that is not completely parallel to said shaft.

18. The golf ball as in claim 12 wherein said sound generator is a piezoelectric transducer.

19. The golf ball as in claim 12 further comprising a plurality of tubular sound pipes extending radially between said housing and said outer shell, each sound pipe being in communication with said chamber for outwardly carrying said audible sounds emitted by said sound generator.

* * * * *